US006384519B1

(12) United States Patent
Beetz, Jr. et al.

(10) Patent No.: US 6,384,519 B1
(45) **Date of Patent: *May 7, 2002**

(54) MICRO-DYNODE INTEGRATED ELECTRON MULTIPLIER

(75) Inventors: Charles P. Beetz, Jr., New Mildford, CT (US); John Steinbeck, Fitzwilliam, NH (US); Robert W. Boertsler, Woodbury; David R. Winn, Wilton, both of CT (US)

(73) Assignee: NanoSciences Corporation, Oxford, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/960,759

(22) Filed: Oct. 30, 1997

Related U.S. Application Data

(60) Provisional application No. 60/027,866, filed on Oct. 30, 1996.

(51) Int. Cl.[7] ..... H01J 43/20

(52) U.S. Cl. ..... 313/103 CM; 313/105 CM; 313/534

(58) Field of Search ..... 313/533, 534, 313/535, 536, 105 CM, 103 CM; 250/214 VT; 427/108

(56) References Cited

U.S. PATENT DOCUMENTS

| | | | | | |
|---|---|---|---|---|---|
| 4,031,552 | A | * | 6/1977 | Bosserman et al. | 313/105 CM |
| 4,482,836 | A | | 11/1984 | Washington et al. | 313/105 CM |
| 4,555,731 | A | * | 11/1985 | Zinchuk | 250/214 VT |
| 4,560,898 | A | * | 12/1985 | Knapp et al. | 313/105 CM |
| 4,683,399 | A | | 7/1987 | Soclof | 313/537 |
| 4,737,623 | A | | 4/1988 | Uhl | 313/105 CM |
| 4,825,118 | A | | 4/1989 | Kyushima | 313/103 CM |
| 4,863,759 | A | * | 9/1989 | Warde et al. | 427/108 |
| 4,990,827 | A | | 2/1991 | Ehrfeld et al. | 313/533 |
| 5,180,943 | A | * | 1/1993 | Kyushima | 313/535 |
| 5,329,110 | A | | 7/1994 | Shimabukuro et al. | 313/533 |
| 5,493,111 | A | | 2/1996 | Wheeler et al. | 313/105 CM |
| 5,514,928 | A | * | 5/1996 | Niewold | 313/105 CM |
| 5,565,729 | A | | 10/1996 | Faris et al. | 313/103 CM |
| 5,635,706 | A | | 6/1997 | She et al. | 250/214 VT |

OTHER PUBLICATIONS

Nuclear Instruments & Methods in Physics Research, A 343 (1994) 263–267 "Status of the Ceramic Multichannel PM tube", Comby et al.

International Conference on Inorganic Scintillators and Their Applications, "Performances of Multi–Channel Ceramic Photomultipliers", Sep. 1995, DELFT University of Technology, The Netherlands, Comby et al.

* cited by examiner

*Primary Examiner*—Michael H. Day
(74) *Attorney, Agent, or Firm*—Lerner, David, Littenberg, Krumholz & Mentlik, LLP

(57) ABSTRACT

A microdynode electron multiplier provides numerous microchannels extending parallel to one another through a layered structure incorporating insulating spacer layers and dynode layers which either incorporate a conductive electrode layer or are contiguous with a conductive electrode layer. The dynode layers include materials with high electron emissivity. The dynode layers can be biased to different electrical potentials to provide a potential gradient along the length of each microchannel. Multi-stage electron multiplication provides high gain. The device desirably is formed as a monolithic, sealed structure with a cathode structure such as a photocathode and an anode structure. The device can provide a multi pixel imaging device of extremely high sensitivity and resolution.

10 Claims, 6 Drawing Sheets

MICRO-DYNODE INTEGRATED ELECTRON MULTIPLIER

CROSS REFERENCE TO RELATED APPLICATIONS

The present application claims benefit of U.S. Provisional Application No. 60/027,866, filed Oct. 30, 1996, the disclosure of which is hereby incorporated by reference herein.

BACKGROUND OF THE INVENTION

The present invention relates to electron multiplier devices, and more specifically relates to dynode arrays, methods of making the same and components incorporating the same.

Photomultiplier tubes (PMT) are versatile, sensitive detectors of radiant energy in the ultraviolet, visible, and near infrared regions of the electromagnetic spectrum. A photomultiplier tube consists of a photoemissive photocathode, an electron multiplier device based on secondary electron emission and an anode to collect the signal electrons, all housed inside a vacuum envelope. Radiant energy such as light incident on the photocathode causes the photocathode to emit electrons. In the electron multiplier device, these electrons are accelerated by an electric field towards an electrode referred to as a "dynode". As the electrons impinge on the dynode, they cause the dynode to emit a larger number of secondary electrons which are in turn accelerated to another dynode producing more secondary electrons. This process continues for several stages, with progressively larger numbers of electrons being emitted at each successive stage. The electrons from the last dynode stage are collected on an anode which is connected to an external circuit, outside of the vacuum envelope. The dynodes may be arranged to provide a tortuous path which changes direction at each dynode. This helps to assure that electrons from each dynode will impinge on the next dynode, and also protects the photocathode against positive ions which may be emitted from the anode or from the dynodes. PMT's are used in industrial and scientific apparatus as detectors in systems for measuring the intensity of a beam of radiant energy. For a large number of applications, the PMT is the most sensitive detector available. The superiority of the PMT arises from the secondary electron emission amplification, which makes it possible for the device to approach "ideal" device performance limited only by the statistics of photoemission. The electron gain of a PMT—the ratio of the number of electrons provided by the last stage to the number of electrons provided by the photocathode—typically ranges from $10^3$ to as high as $10^8$. Thus, even when the radiant energy to be detected is extremely weak, a PMT can provide output signals at levels which are easily measured by auxiliary electronic equipment. PMTs can also have extremely fast time response (~100 ps), which provides the capability for measuring radiant energy varying at a rapid rate. Stated another way, the combination of gain and bandwidth provided by PMTs is unmatched by any other detector. PMTs have very low quiescent power when the individual dynodes are powered separate from an active power supply circuit. A dynode set can also be used to amplify a stream of electrons or ions from a source other than a photocathode, and can provide similar advantages in these applications.

The dynode sets used in measurement devices typically provide only one channel or set of cascaded dynode stages, and amplify only one stream of electrons. Thus, in a light-sensing PMT, the electrons emitted by the entire photocathode are amplified together in one stream of electrons so that the device provides a single output signal representing the light incident on the entire photocathode.

Imaging devices typically must process a separate signal for each of many picture elements or "pixels" in a two-dimensional array of pixels constituting an image. For example, a monochrome (black and white) image can be represented by a set of signals, each representing the brightness of the image within a pixel at a particular position. Many common imaging devices, such as the charge-coupled-device or "CCD" imaging devices in home video cameras and in electronic still cameras incorporate a two-dimensional array of detectors incorporating a separate detector for each pixel in the image. A lens focuses the image onto the array, and each detector provides a signal representing the brightness of one pixel in the image. These signals can be reconstructed to provide an image, such as a television or still picture representing the original image. To provide reasonable resolution in the resulting image, the imaging device should include a large number of detectors. Even a medium-quality imaging system such as a consumer video camera requires tens of thousands of pixels; high quality imaging requires hundreds of thousands of pixels. However, with common CCD technology, there is a direct relationship between the size of each detector and the sensitivity of the device, and a similar relationship between the size of each detector and immunity to random electronic noise. Thus, the spatial resolution of the device—the number of detectors which can be provided in a device of a given size—is limited. CCD technology has branched into two major classes. One class provides low cost sensors for large consumer markets such as camcorders, line scanners, etc. whereas the other class provides very high quality CCDs for scientific imaging. The low cost sensors are capable of achieving high data rates (~60–100 MHz for certain line scanners), they suffer in image quality and are not satisfactory for high frame rate scanning arrays. The high quality CCD sensors, while providing excellent low noise performance, cannot provide that performance at high frame rates. Thus, while Si based CCD technology has made great progress, there is still a large gap between what is desired for high quality imaging and performance of the present generation of CCD sensors. The CCD devices do not provide the high gain, bandwidth and response time of dynode devices.

Attempts have been made to fabricate plural-channel dynode arrays heretofore. Ehrfeld et al., U.S. Pat. No. 4,990,827 and Shimabukuro et al. U.S. Pat. No. 5,329,110 propose making arrays of small electron multipliers by certain microfabrication techniques. However, the techniques and structures taught by these references are suitable for making linear arrays of electron multipliers; they are not well suited to fabrication of a two-dimensional array of dynode channels.

Comby et al., Nuc. Inst. Meth. Phys. Res. A 343, 263 describe an all ceramic multichannel electron multiplier in a PMT having four imaging pixels of 0.6 mm diameter employing a five stage dynode structure. The dynodes are provided as metallic plates arranged along a channel. Openings in the plates are offset from one another to form a tortuous path. According to the reference, the results of gain measurements from these devices demonstrated that machined channels can be built with high gain. Using a Ag—O—Cs coated dynode material, they were able to achieve gains of about 100 for the five stage multiplier, amplifying photoelectrons from a $CS_3Sb$ photocathode. As set forth in Comby et al, Proceedings. International Conference On Inorganic Scintillators and Their Applications, SCINT95, DELFT Univ. of Tech. The Netherlands, September (1995), by treating Au dynodes with Sb—Cs, gains in excess of $10^3$ were demonstrated in an all ceramic PMT with 0.6 mm pixels in a 4×4 array. These articles propose that it may be possible to fabricate a 256-pixel device. Thus, dynode array devices available heretofore do not provide the spatial resolution needed for high-quality imaging.

Another electron multiplying device is known as a microchannel plate or "MCP". MCP's typically have numerous continuous channels extending through an insulating layer. A coating of a material having high electron emissivity is applied on the interior of each channel. The coating has a high electrical resistance. A voltage applied through electrically conductive layers extending on opposite side of the insulating layer creates a potential gradient between opposite ends of the coating. Electrons entering each channel are accelerated along the channel by the potential gradient, and impinge on the walls of the channel. Such collisions yield secondary electrons which are also accelerated and provide further collisions. Although MCP's provide advantages such as fast rise times, high spatial resolution and low cross-talk between adjacent channels, the gain of a MCP deteriorates at relatively low electron currents. After electrons are emitted from each portion of the electron-emissive channel lining, that part of the layer must be recharged by conduction through the lining. The high resistance of the lining limits the rate of recharging. Thus, the gain of a typical MCP deteriorates significantly at electron currents of about 0.1 Coulomb per $cm^2$ of plate area. Moreover, because current continually flows through the resistive coatings on the channel walls, MCPs typically draw appreciable power at all times. This limits their use in battery-powered devices.

SUMMARY OF THE INVENTION

One aspect of the present invention provides a multichannel microdynode device. A device in accordance with this aspect of the invention includes a porous structure defining an entry side and an exit side. The structure incorporates a plurality of dynode layers and a plurality of electrically insulating spacer layers. These layers are disposed in alternating sequence between the entry side and the exit side. Each microchannel has an entrance aperture at the entry side of the porous structure and an exit aperture at the exit side of the porous structure. Each channel has a lengthwise direction between the entrance and exit apertures. As used herein with reference to a channel, the term "forward direction" means lengthwise direction from the entrance aperture to the exit aperture, whereas the "reverse" direction is the opposite direction. Each microchannel preferably has a mean diameter less than about 150 microns. The structure defines walls surrounding each microchannel and substantially segregating each microchannel from the other microchannels. The device further includes an electron emissive material in the microchannels within the dynode layers and means for connecting the dynode layers to biasing voltages. The term "electron-emissive material" as used herein refers to a material having a high coefficient of secondary electron emission.

Most preferably, the dynode layers and the spacer layers are bonded to one another and form a monolithic structure. In a particularly preferred arrangement, the dynode layers and the spacer layers have confronting surfaces bonded to one another over substantially the entire extent of these surfaces other than the areas occupied by the microchannels. The confronting surfaces of the dynode layers and the spacer layers may be bonded directly to one another or else may be bonded to one another by layers of bonding material interposed between these layers. The dynode layers may be fabricated from a semiconductive or nonconductive structural materials such as undoped silicon and may have via liners formed from an electrically conductive material such as a metal overlying the structural material on the dynode regions of the microchannel walls, within the dynode layers. In this instance, the dynode layer may include, or may be contiguous with, a conductive layer such as a metallic layer which extends to the conductive walls of the holes. Alternatively, the dynode layer may be formed from a conductive material such as a metal, and the metal of the dynode layers may define the interior walls of the holes in the dynode layer. In either case, the conductive layers act to connect the dynode layers to biasing voltage and provide a direct, conductive connection to the interiors of the holes in the dynode layer. The conductive layer in or contiguous with each dynode layer may be connected to a source of voltage at a potential different from the potentials connected to the other dynode layers. Thus, a potential gradient is maintained along the length of each microchannel by the different potentials, with more positive potential toward the exit aperture. Electrons entering the entrance aperture of each microchannel will be accelerated along the channel in the forward direction and will impinge upon the dynode layers, causing secondary electron emissions. The secondary electrons in turn are accelerated and pass along the channel where they impinge upon the walls in further dynode layers, and the process continues to provide electron multiplication or gain.

In particularly preferred structures according to this aspect of the present invention, the microchannels have mean diameters less than about 100 microns, more preferably less than about 25 microns, and most preferably between about 5 microns and about 10 microns. The small diameter of the microchannels provides several significant effects. A substantial number of electrons will collide with the walls of the channel even if the channel is straight or only gently curved. Likewise, any positively charged ions entering the channels at the exit end or generated within the channels will have a high probability of collision with the walls of the channels. Accordingly, the probability of an ion being accelerated along the channel and passing out of the channel in the reverse direction will be very small. Thus, although the channel may be curved, it is not necessary to provide a tortuous path. Thus, the central axis of each microchannel may be substantially straight and may extend in a smooth curve or else may extend in a smooth curve, desirably with two or fewer changes of direction of curvature between the entry side of the structure and the exit side. The microchannels may have essentially any cross sectional shape. A cross sectional shape which is a circle or a regular polygon, such as a square, is particularly preferred. In a particularly preferred arrangement, the walls of the microchannel slope inwardly towards one another within each dynode layer in the direction through the dynode layer towards the exit end of the structure. This further enhances the probability of electron collisions with the walls of the dynode layer and hence further enhances the gain of the system. In a particularly preferred arrangement, the center-to-center distance between the central axes of adjacent microchannel ranges from about 1.01 to about 2 times the main diameter of each microchannel. Thus, the microchannels occupy a substantial portion of the area of the porous structure. Stated another way, the open area or combined cross sectional areas of the microchannels measured at the entrance apertures of the microchannels desirably constitutes at least about 50% and more preferably at least about 75% of the area of the porous structure. Still higher open area percentages, in some cases up to 98%, at the entrance apertures are attainable where the microchannels taper in the forward direction.

In a further embodiment of the invention, the dynode layers may be provided with mesh structures subdividing each microchannel at each dynode layer. Each such mesh structure has non-scale passages, substantially smaller than the microchannel, extending through it in the lengthwise direction. The walls of these passages have the electron emissive material thereon. Such a mesh structure provides an even greater probability of collisions between electrons passing lengthwise along the channel, and an even greater probability of collision for any positive ions passing in the reverse direction along the channel.

The preferred electron multiplier structures in accordance with the foregoing aspects of the invention provide all of the advantages of a dynode structure, including high gain, low current consumption and high frequency response, and can also provide very high spatial resolution. Thus, the preferred structures in accordance with the foregoing aspects of the invention provide closely spaced microchannels. Moreover, the microchannels are effectively isolated from one another, so that the structure provides low crosstalk between adjacent channels. In effect, the preferred structures in accordance with this aspect of the invention combine the best advantages of microchannel plates with the best advantages of dynode structures.

Electron multiplier structures in accordance with the foregoing aspects of the invention desirably are used in conjunction with a cathode structure capable of emitting electrons overlying the entry side of the structure so that regions of the cathode structure are exposed to entrance apertures of the microchannels, and an anode structure overlying the exit side of the porous structure. Most preferably, the cathode structure and the anode structure are sealingly connected to the porous structure, so that the anode structure, cathode structure and porous structure cooperatively maintain vacuum within the microchannels. The anode structure and cathode structure may be formed with the porous structure, or bonded to the porous structure, to provide a single monolithic device. Such a monolithic device provides a compact, rugged unit which can be employed without any external shell or vacuum envelope. The anode structure may include conductors extending to the exterior of the monolithic device, which eliminates the need for any separate feed-throughs. The cathode structure may incorporate a photocathode adapted to emit electrons in response to light, whereas the anode structure may incorporate a plurality of separate anodes overlying the exit apertures of the microchannels. Preferably, an individual anode is aligned with the exit aperture of each microchannel. In this case, the electrons impinging on the individual anode associated with each microchannel will represent light impinging on the particular region of the photocathode overlying the entry aperture of that microchannel. Thus, the device will provide a plurality of separate signals, each representing the brightness of light in a single pixel. These signals can be handled and processed in a microelectronic circuit. The microelectronic circuit may be formed as part of the same monolithic structure with the other elements of the device. Such a monolithic device can be used instead of a CCD sensor and can be made with comparable spatial resolution to a CCD sensor. However, the device in accordance with these embodiments of the invention can provide markedly superior signal output levels and bandwidth.

In other embodiments, the anode structure may incorporate a phosphor layer adapted to emit light in response to electrons impinging on the phosphor layer. Where the cathode structure includes a photocathode, the device will act as a light amplifier; the light emitted by the anode phosphor will be far brighter than that impinging on the photocathode. These devices can be incorporated in night vision systems. In still other embodiments, the cathode structure may include plural individual cathodes adapted to emit electron currents. An appropriate circuit may be provided for selectively energizing individual cathodes to cause these individual cathodes to emit. This will cause individual portions of the anode structure phosphor layer to be illuminated. Such a device may be used as a flat panel display.

Further aspects of the present invention provide methods of making microdynode devices. A method in accordance with one embodiment of the invention includes the steps of providing a plurality of electrically insulating spacer layers having holes therein and providing a plurality of dynode layers also having holes therein. These steps are performed so that the spacer layers and dynode layers are stacked in alternating sequence, with at least one of the dynode layers being sandwiched between two of the spacer layers and so that the holes in the dynode layers are aligned with the holes in the spacer layers to form continuous microchannels extending through the stack. A method in accordance with this aspect of the present invention desirably includes the step of providing an electrode emissive material in the holes of each dynode layer before that dynode layer is sandwiched between spacer layers. The step of providing an electron emissive material in the holes of each dynode layer may include the step of depositing either the electrode emissive material itself or a precursor adapted to form an electron emissive material into the holes of each dynode layer. For example, the step of providing these plural layers may include the step of forming the layers sequentially, one above the other by selectively depositing the materials of the dynode layers and spacer layers.

In accordance with a further aspect of the invention, a microdynode device may be made by a method including the steps of first providing a set of elongated mandrels extending codirectionally with one another and desirably parallel to one another and then depositing an electrically insulating material over the mandrels to form the spacer layers and a second material to form the dynode layers. These materials are deposited in alternating sequence to form a stack including the dynode layers and the spacer layers in alternating sequence. The method further includes the step of removing the mandrels so as to leave elongated microchannels extending through the stack and including holes extending through the various layers. This method may include the step of depositing an electron emissive material for a precursor adapted to form such a material onto the mandrels adjacent the previously deposited layers of the stack before depositing the second material to form a new dynode layer. Thus, the deposited emissive material will form a lining in the holes of the newly formed dynode layer. The second material deposited to form a dynode layer desirably is an electrically conductive material such as a metal. The mandrels may be formed by a molding process as further discussed below.

A method according to a further aspect of the invention is performed by making one or more dual layer structures. Each dual layer structure is made by providing a spacer layer of an electrically insulating first material, forming depressions in a top surface of this spacer layer and then depositing an electrically conductive material on the top surface to form a dynode layer. The depositing step desirably is performed so that the conductive material extends into the depressions on the top surface so as to form hollow conductive via liners in the depressions as part of the dynode layer. An electron emissive layer is provided on the interior walls of the vias liners and holes are formed extending from the depressions through the spacer layer to the bottom surface of the spacer layer. These steps are repeated so as to form a plurality of dual layer structures and thus form a stack of a plurality of spacer layers and dynode layers. Thus, the dynode layer on the top surface of each spacer layer faces the bottom surface of the next higher spacer layer in the stack. The steps are performed so that the holes and via liners form continuous microchannels extending through the stack. The step of providing each spacer layer formed by depositing insulating first material on the top surface of a previously formed dynode layer so as to form a new spacer layer. The remaining steps of forming depressions depositing the conductive material providing the electron emissive layer and forming the holes may be performed on each new spacer layer after the material of that layer is deposited. Thus, the stack continually grows by addition of new layers. The via liners of each dynode layer may be filled temporarily with a sacrificial plug before depositing the insulating first material to form the next higher spacer layer. The step of forming the holes in the various spacer layers may be formed after the stack is formed and after the spacer layers have been deposited by etching the stack so as to form the holes in all or several of the spacer layers in a single operation. To facilitate etching of holes in the spacer layer, the step of providing the electron emissive material in the via liners desirably includes the step of depositing the electron emissive material so that the emissive material does not coat the bottoms of the depressions. Thus, the electron emissive material may be applied by sputtering or other processes which direct the material along directions oblique to the top surface, so that the material is deposited on the interior walls of the vias, but not on the bottom surfaces of the depressions.

Yet another method of making a microdynode device includes the step of forming an insulating spacer layer and providing a dynode layer on a top surface of the insulating layer. The dynode layer is selectively treated in a plurality of spots so as to form a mesh in each spot, with a plurality of nanoscale passages extending through the dynode layer. For example, where the dynode layers are formed from aluminum, the step of selectively treating the dynode layer may include the step of anodizing the aluminum in the spots. Where the dynode layers are formed from silicon the step of selectively treating the dynode layer in the spots may include the step of anisotropically etching the dynode layer in the spots. An electron emissive material is provided on the interior surfaces of the passages holes are formed in the spacer layer in alignment with the spots so that each hole is in communication with a multiplicity of passages. These steps are repeated and a stack including a plurality of spacer layers and a plurality of dynode layers is formed so that the dynode layer on the top surface of each spacer layer faces the bottom surface of the next higher spacer layer and so that the holes and the mesh spots form continuous microchannels extending through the stack, with the mesh of each spot on a particular dynode layer extending across the microchannel. Desirably, the step of providing a spacer layer is performed by providing a layer of a curable material such as a photoimagable polymer and selectively curing this material to leave a plurality of uncured spots extending through the layer of curable material. The selective curing steps and the steps of selectively treating the dynode layers desirably are performed so that the mesh spots in the dynode layers are disposed in alignment with the uncured spots of the spacer layers. The steps of forming the holes in these spacer layers may be performed by removing the uncured material in the spots of each spacer layer after formation of the mesh in the dynode layer atop that spacer layer. The uncured material may be left in place while additional layers are deposited and the uncured material in the spots of several spacer layers may be removed simultaneously as by directing a washing solution through the microchannels.

Yet another method of making a microdynode device includes the step of providing plural layers of silicon having holes therein and having silicon dioxide layers. A plurality of dynode layers of silicon are also provided. These have holes and a layer of electron emissive material in the holes. Each dynode layer has a layer of an electrically conductive material on a top or bottom surface of the dynode layer. The spacer layers and the dynode layers are stacked so that the holes in the layers are aligned with one another and form continuous microchannels and the stacked layers are then bonded to one another as by anodic bonding to form a monolithic structure.

Thus, particularly preferred forms of the present invention provide a fully integrated, very compact, monolithic, high pixel density, imaging electron multiplier with comparable pixel size and spatial resolution to CCD detectors, but with considerably higher sensitivity, improved signal to noise, faster readout, and lower manufacturing cost. This integrated electron multiplier technology will enable a new generation of compact, rugged, high resolution imaging electron detectors that are expected to find widespread applications in scientific instrumentation, medical imaging, document transmission and reproduction, digital video and still cameras, telecommunications and machine vision.

These and other objects, features and advantages of the present invention will be more readily apparent from the detailed description set forth below, taken in conjunction with the accompanying drawings.

DETAILED DESCRIPTION OF THE PREFERRED EMBODIMENTS

Figure 1:
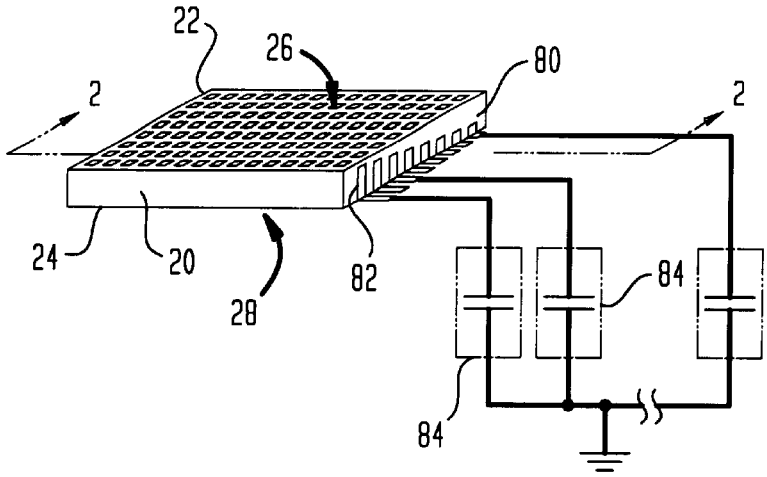
FIG. 1 is a diagrammatic perspective view depicting a dynode assembly in accordance with one embodiment of the invention.

An assembly in accordance with one embodiment of the invention includes a porous structure 20 having a top or entrance side 22 and a bottom or exit side 24. A cathode structure 26 overlies the entrance side 22 whereas an anode structure 28 is provided at the exit side. Cathode structure 26 includes a light transmitting window 30 (FIG. 2) and an electrically conductive coating of a conventional photoemitting material 32 on the bottom surface, i.e., on the surface facing toward porous structure 20. Anode structure 28 includes a plurality of individual electrically conductive anode elements 32 extending through an insulating layer 34. Anode elements 32 may be adapted for connection to a further electrical circuit. For example, each anode element may include, or may be electrically connected to, a bump or solder ball suitable for mounting to a circuit board. Alternatively, the anode structure may itself include an electrical circuit having leads or traces extending to the various anode elements.

Figure 2:
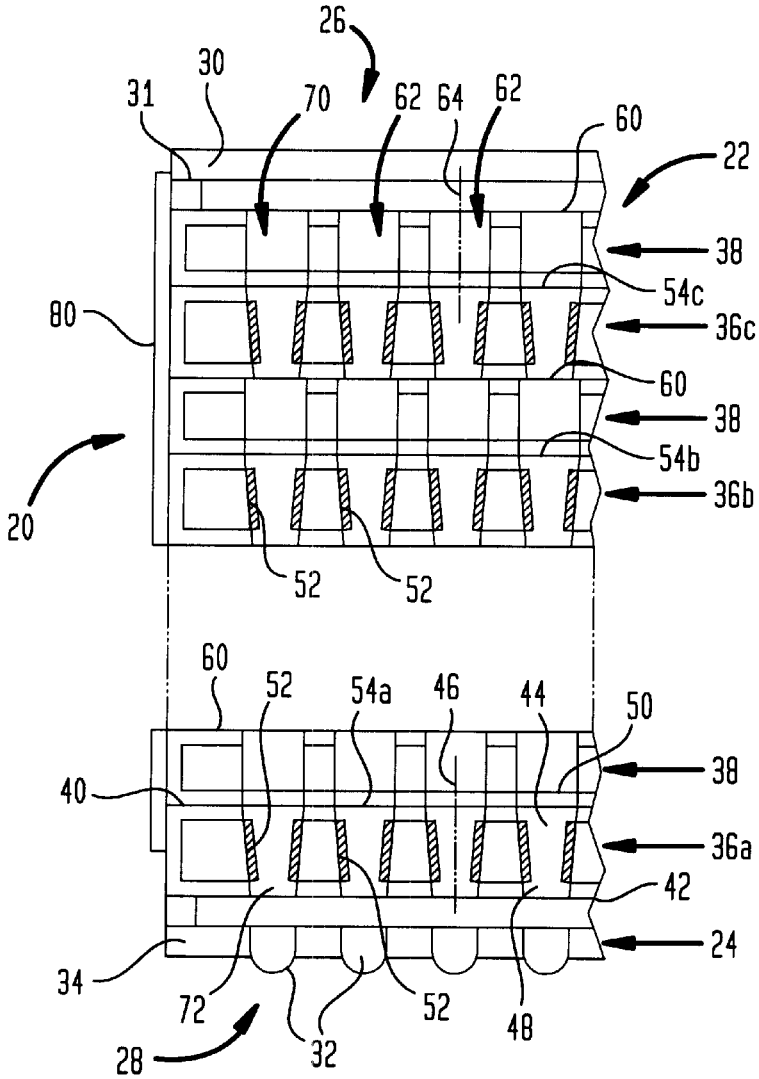
FIG. 2 is a diagrammatic sectional view taken along line 2—2 in FIG. 1.

Porous structure 20 includes a plurality of generally planar, plate-like dynode layers 36 stacked in alternating arrangement with a plurality of generally planar spacer layers 38. Although only a few dynode layers and spacer layers are depicted in FIG. 2, the actual structure may include any number of these layers, typically from 1 to 100 dynode layers and a similar number of spacer layers.

Each dynode layer 36 has a top surface 40 facing toward the top or entry side 22 of the porous structure, a bottom surface 42 facing toward the bottom of the porous structure and a plurality of holes 44 extending through the layer from the top surface to the bottom surface. Each hole has a lengthwise axis 46 and a mean diameter of about 150 microns or less. As used in this disclosure with reference to a hole or channel, the term "mean diameter" refers to the mean dimension of the hole or channel in directions transverse to the lengthwise axis of the hole or channel. The mean diameters of the holes desirably are about 0.005–100 microns, more preferably less than about 100 microns, still more preferably less than about 25 microns and most preferably between about 5 microns and about 10 microns. The holes 44 in the dynode layers desirably have an aspect ratio or ratio of length to mean diameter, of at least about 0.25, or at least about 2, or at least about 10, and desirably between 1–100. Holes 44 are disposed in a regular pattern on the dynode layer. The center-center spacing of the holes preferably ranges from about 1.01 to 2 times the mean diameter of the holes.

Figure 3A:
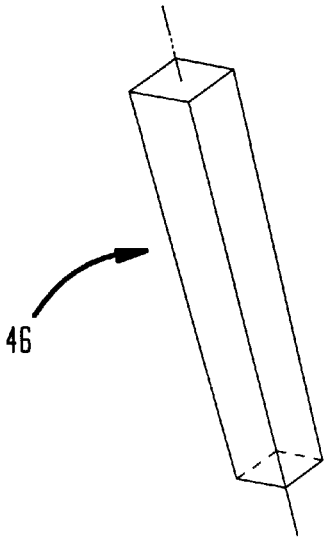
FIGS. 3A, 3B and 3C are diagrammatic perspective views depicting whole shapes utilized in certain embodiments of the invention.
Figure 3B:
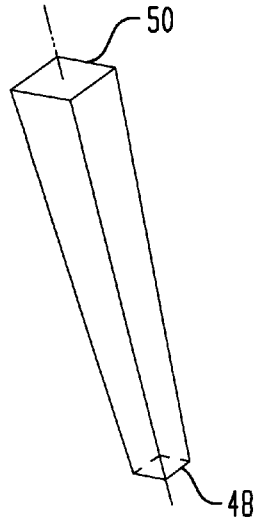
Figure 3C:
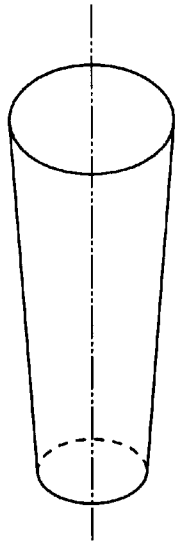

Holes 46 may have various cross-sectional shapes. As used in this disclosure with reference to a hole or channel, the term "cross-sectional shape" refers to the shape as seen in section plane transverse to the lengthwise direction or central axis. For example, the holes may have a cross-sectional shape of a regular polygon such as the square-shaped hole of FIG. 3A or circular as seen in FIG. 3C. The cross-sectional dimensions may be uniform in the lengthwise direction as in FIG. 3A or else may be tapered, so that the mean diameter of the hole, and preferably all of the cross-sectional dimensions of the hole, decrease in the forward direction. Thus, as seen in FIG. 2 and in FIG. 3B, the bottom end 48 of the hole, at the bottom surface 42 of the dynode layer, is narrower than the top end 50 at the top surface 40 of the dynode layer. This will increase the probability that electrons traveling in the forward direction will collide with the walls of the hole. Tapered holes are particularly useful when the hole has a relatively low aspect ratio.

The dynode layers can be fabricated using a variety of techniques including anisotropic plasma etching, light assisted and normal anodization, replica casting, photolithographic patterning, patterned physical vapor deposition (PVD), chemical vapor deposition (CVD) or electrodeposition. The dynode layer can be formed from a variety of materials including: amorphous and crystalline semiconductors including the group IV semiconductors (silicon, germanium, tin and diamond), the $A_xB_{1-x}C_yD_{1-y}$ semiconductor materials where A and B are in the group of B, A1, Ga, In, and T1, C and D are in the group of N, P, As, Sb and Bi and x and y are in the range from 0 to 1, both n and p types of these semiconductors, metals in the group of aluminum, nickel, gold, copper, magnesium, beryllium, silver, lead, tin, alloys and oxides thereof, and dielectric materials including alumina, ceramics, glasses and polymers such as polyimides and PMMA.

The interior surfaces of the holes in the dynode layers form secondary emission surfaces. An electron-emissive material 52 is present at the interior surfaces of the holes in the dynode layers. As used in this disclosure, the term "electron-emissive material" means a material having a secondary electron emission coefficient of more than 1, i.e., a material which will emit a number of secondary electrons greater than the number of electrons impinging on the material. The electron-emissive material may be fabricated either as an integral part of the mechanical structure of the dynode layer hole walls or formed on some or all of the hole wall surfaces of the channel by deposition processes such as physical vapor deposition, chemical vapor deposition, electrodeposition or electroless deposition. The electron-emissive material can also be formed by chemical reaction of a material in place on the hole wall, preferably with a gaseous reactant. For example, the electron-emissive material may be the product of oxidation or nitridation of a material on the hole wall. The electron-emissive materials include materials mentioned above as materials of fabrication of the dynode layer, and reaction products of such materials such as oxides and nitrides of these materials. Other preferred electron-emissive materials include materials selected from the group consisting of $Al_2O_3$, CuBe, $CsSb_3$, $SnO_2$:Sb, $SnO_2$:F, $SnO_2$, $In_2O_3$, $In_2O_3$:Sn, $MgIn_2O_4$, $InGaO_3$, $Bi_2O_3$, MgO and PbO. In the foregoing formulae, the colon (:) means "doped with". The dynode layers desirably are conductive or semiconductive at least in the regions constituting the walls of the holes. For example, the regions of the dynode layers may have an effective volume resistivity less than 1000 Ohm-cm in the regions constituting the walls of the holes. Where the structural material of the dynode layer is a dielectric, the dynode layer may have a layer of a metal or other conductive material lining the walls of the holes. Also, where the dynode layer is formed from a semiconductor such as Si, the dynode layer can be doped in bulk or selectively in the regions constituting the hole walls to enhance its conductivity.

Each dynode layer 36 has an electrode layer 54 (FIG. 2) on its top surface. The electrode layers are electrically conductive, and preferably have a resistivity of less than 10 Ohm-cm. Alternatively or additionally, an electrode layer may be provided on the bottom surface of each dynode layer. Where the structural material of the dynode layer is electrically conductive, as, for example, where the dynode layer is formed from aluminum, the structural material itself serves as the electrode layer and separate electrode layers are unnecessary. As further discussed below, the electrode layers are connected to electrical potential sources. Electrode layers on the top and bottom surfaces can be formed by deposition techniques such as oblique PVD deposition of electrical conductors such as aluminum. Where a conductive coating is provided on the interior surfaces of the holes, the conductive coating desirably is formed integrally with the electrode layers. As a further alternative, the electrode layers may be fabricated as separate metallic sheets with holes in a pattern matching the pattern of holes in the dynode layers, and one or more such separate electrode layer may be positioned contiguous with a surface of the dynode layer in the stack.

Each spacer 38 has a top surface 60 facing toward the top or entry side 22 of the structure, a bottom surface facing in the opposite direction and holes 62 extending through the spacer layer from the top surface to the bottom surface. The holes in each spacer layer have central axes 64 and have mean diameters and cross-sectional shapes similar to the holes in the dynode layers. The holes in each spacer layer are arranged in a pattern corresponding to the holes of the dynode layers. The spacer layers can be fabricated using materials and techniques similar to those discussed above with reference to the dynode layers. However, the spacer layers are electrically insulating; the spacer layers preferably have effective volume resistivity in the top-to-bottom direction greater than about $10^3$ Ohm-cm, and preferably $10^5$ Ohm-cm or higher. For example, where the spacer layers are formed from Si, the spacer layers may be oxidized in whole or in part so as to convert some or all of the Si to $SiO_2$ The spacer layers are designed so that an electron entering a hole 64 and passing in the forward direction, toward the bottom of the layer, will have as low a probability as feasible to make a collision with the inner surfaces of the hole. Thus, the cross-sectional dimensions of the holes in the spacer layers preferably do not taper inwardly in the forward direction. Also, the thickness of each spacer layer desirably is as small as possible while maintaining the ability to withstand the electrical potential which will be imposed across the layer in use, typically about 10 to about 2000V. For example, the thickness of each spacer layer, and hence then length of each hole 62 along its axis 64, preferably is at least 1 micron to withstand a voltage across the length of the hole of about 10 V.

The dynode layers 36, spatial layers 38 and the electrode layers 50 cooperatively define the monolithic, solid porous structure 20. The layers are superposed, one above the other so that the holes of the dynode layer and the spacer layers are aligned with one another. Thus, each set of aligned holes forms a continuous microchannel having an entrance aperture 70 at the top surface 22 of the porous structure and an exit aperture 72 at the bottom surface 24 of the porous structure. Each of the anode elements 32 of the anode structure 34 is aligned with the exit aperture 72 of one microchannel. In the embodiment illustrated in FIG. 2, the central axes 62 and 46 of the various holes constituting each microchannel are aligned with one another and form a continuous, straight central axis in each microchannel. The walls of the holes in the various layers form a continuous microchannel wall surrounding the microchannel from the entrance end to the exit end and segregating that microchannel from the other microchannels. All of the microchannels thus extend separately and parallel to one another. The various layers constituting the monolithic structure are bonded to one another at least at their edges and preferably over their entire surfaces. As discussed below, the various layers may be fabricated one atop the other and may be bonded to one another as they are formed, or else may be formed separately from one another stacked in alignment with one another and bonded to one another, as by anodic bonding, brazing or other suitable processes. Cathode structure 26 and anode structure 28 are sealingly connected to the top and bottom surfaces of the porous structure, and hence the anode structure, cathode structure and porous structure cooperatively define a sealed enclosure. The interior of this enclosure, including the interiors of the microchannels are maintained under vacuum by action of the sealed enclosure. Typically, the structure is maintained under vacuum when the last element is formed or applied. For example, where the cathode structure is assembled to the remainder of the structure after the remainder of the structure is formed, this assembly operation may be conducted inside an evacuated chamber so as to seal the vacuum inside the structure. Preferably, the total gas pressure within the microchannels is less than about $10^{-6}$ Torr.

The assembly further includes conductors 80 extending to the electrode layer 54 in or associated with each dynode layer. These conductors 80 are formed separately from one another, so that the conductor extending to the electrode layer of one dynode layer does not contact the electrode layer of any other dynode layer. A further conductor 82 extends to the photoemissive layer 32 of the cathode structure. Although the conductors 80 and 82 are depicted in FIG. 1 as extending vertically along the sides of porous structure 24, any suitable conductor configuration may be employed. For example, the stacked components may be provided with internal vertically extending conductors fabricated by techniques common in the semiconductor industry. Alternatively or additionally, the electrode layers in or associated with each dynode layer may protrude from the structure and may be connected by a separate wire or lead such as a conventional wire bond to a circuit panel.

The various conductors 80 and 82 are connected to a set of voltage sources 84 arranged to apply different voltages to the various layers. The voltage sources 84 are arranged to apply the most negative voltage to the electron emissive layer of the cathode structure; to apply a slightly more positive voltage to the first or top most dynode layer 36C and to apply progressively more positive voltages at the dynode layers closer to the bottom or exit end of the structure. This provides a voltage gradient along each microchannel. Desirably, the voltage sources are arranged so that they do not consume substantial power in the absence of electron currents passing through the microchannels. For example, the voltage sources may be provided as separate taps on a tapped Cockroft-Walton voltage multiplier. This device may be provided in a hybrid circuit package with the other components. Any other suitable set of voltage sources may be employed. A resistive voltage divider network with separate taps extending to each dynode layer may be employed. However, such a resistive device is less preferred because it consumes appreciable power at all times to maintain the voltage gradient.

In operation, light impinging on the cathode structure 26, such as an image focused by a lens (not shown) onto the cathode structure causes the electron emissive layer 32 to emit electrons. The emission from each elemental region or pixel of the cathode structure will be directly related to the brightness of the light in that pixel. The emitted electrons from each pixel enter the entrance aperture 70 of the microchannel aligned with that pixel. The electrons are accelerated in the forward direction by the applied voltage gradient. Preferably, the dimensions of the holes in each dynode layer are selected so that a majority or most of the electrons entering the top of each dynode layer impinge on the walls within that dynode layer. The impinging electrons provoke emission of secondary electrons from the electron emissive surfaces 52. The secondary electrons are accelerated towards the next dynode layer and the process continues with progressively increasingly numbers of electrons being emitted from each dynode layer. The electrons passing within each microchannel are isolated from the electrons in the other microchannels, so that there is essentially no cross-talk between adjacent microchannels. Thus, a stream of electrons is emitted from the exit aperture 72 of each microchannel. The electron current in each such stream represents the intensity of light falling on the associated pixel of the cathode structure. The emitted electrons impinge on the anode element 32 aligned with the exit aperture and hence provide an electrical signal representing the intensity of the light in the associated pixel.

A fabrication process in accordance with one embodiment of the invention is performed by building individual dynode layers 36 and spacer layers 38, and then stacking these preformed layers atop one another so that the holes are aligned with one another. The process may be performed using Si wafers as the starting material to form each layer. Thus, wet etch, bulk micromachining in a KOH solution is used to create windows in thinned Si wafers (~10–100 ($\mu$m thick). These windows form the holes. The spacer layers are formed by thermally oxidizing machined silicon wafers to form a thick oxide layer ~2–10 microns thick. This oxidation treatment is sufficient to provide the necessary insulation between dynode stages.

Each dynode layer is also built on a machined Si wafer. The areas of the wafer which have been etched are photomasked and a layer of copper-2% beryllium metal is deposited on the open areas. Heating this structure in oxygen transforms the Cu-2% Be into a high secondary emission surface for the dynode. An aluminum metal layer electrode layer is then deposited and patterned on the structure to provide the electrode layer.

The components are consolidated into a stack as discussed above. The stack is assembled layer by layer and each successive layer anodically bonded to the stack until all layers are integrated into the monolith as shown in FIG. 2. As discussed above, bias connections and anode output connections are integrated into the structure. Note the absence of a separate vacuum envelope and glass-metal feed-throughs. The vacuum envelope is integral with the monolithic structure.

Figure 4:
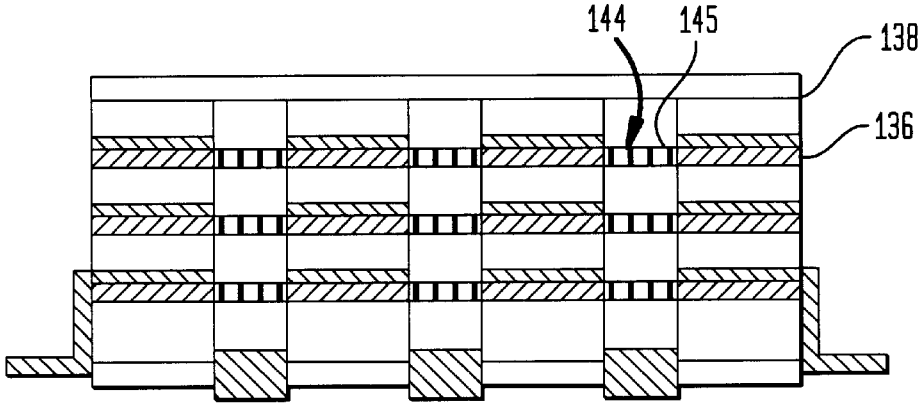
FIG. 4 is a diagrammatic sectional view similar to FIG. 2, but depicting a device in accordance with a further embodiment of the invention.

A process in accordance with a further embodiment utilizes anisotropic etching techniques to build a mesh structure 145 extending within the holes 144 of each dynode layer 136 (FIG. 4) By utilizing an electrochemical process arrays of nano-scale passages extending lengthwise through the layer may be fabricated in a layer of silicon such as a silicon wafers. The mesh can be etched using a light assisted electrochemical process similar to that discussed in the literature as, for example in M. J. J.

Theunissen, J. A. appels, and W. H. C. G. Verkuylen, J. Electrochem. Soc., 117, 959 (1970); M. J. J. Theunissen, J. Electrochem. Soc., 119, 351 (1972); M. J. Hill, J. Electrochem. Soc., 120, 1425 (1973); and V. Lehmann, J. Electrochem. Soc. 140, 2836 (1993), the disclosures of which are hereby incorporated by reference herein. Thus, before the layers are assembled into a stack, each dynode layer 136 is selectively treated in an area which is to form a hole 144. For example, the remainder of the layer may be masked using a photographically curable resist and exposed to the etching process only in spots left uncovered by the resist. The light assisted etching process forms a hole through the layer with a mesh structure filling the hole. The mesh structure includes an array of nano-scale passages extending generally parallel to one another. The hole 144 may have cross-sectional dimensions as discussed above. Each nano-scale passage has cross-sectional dimensions far smaller than the hole. For example, each nano-scale passages may have cross-sectional dimensions on the order of about 50 Angstroms to about 10 microns. The microchannel mesh is provided with electron-emissive material on the interior of the nano-scale passages by depositing an emissive material such as GaP onto the surfaces of the passage walls using CVD. The dynode layers 136 are assembled with spacer layers 138 and with other components as discussed above to form a stack as shown in FIG. 4. A low temperature braze alloy such as Al/Ge is deposited over the confrontings surfaces of the layers and the entire stack assembled and then given a consolidating heat treatment to bond the layers together into an integral solid. This results in a structure having a set of microchannels extending through the stacked layers, with the mesh disposed in the microchannel at each dynode layer. The device operates in the same way as the device discussed above. The electrons passing lengthwise along the microchannels will pass into the nano-scale passages of the mesh. The extremely narrow passages of the mesh provide a very high probability of collision with the walls of the passages, and thus provide high gain.

A process according to a further embodiment uses a self-aligned strategy. This approach starts by fabricating the anode readout structure 228 on a silicon wafer followed by subsequent fabrication of the alternating dynode and spacer layers until the desired number of stages of the electron multiplier have been fabricated.

Figure 5A:
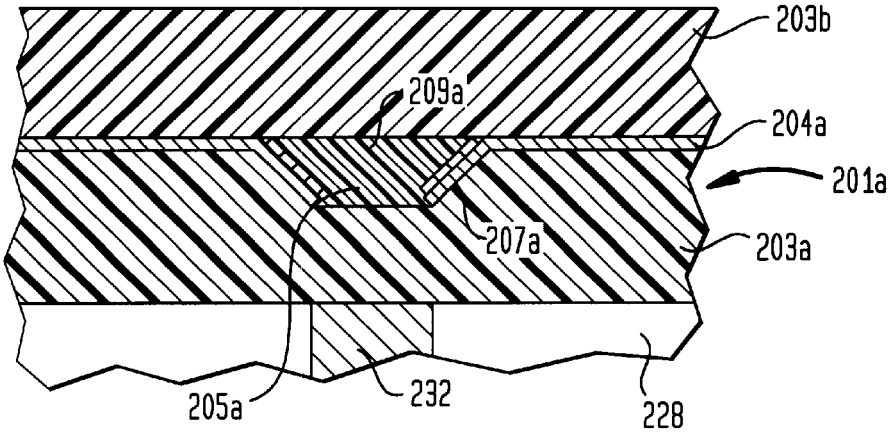
FIGS. 5A through 5D are fragmentary diagrammatic sectional views depicting stages in a process in accordance with a further embodiment of the invention, for fabrication of a device according to a further embodiment.

This process proceeds by building up successive bi-layers, each consisting of a spacer layer of insulating polyimide covered with a Ag-5% Mg layer that forms the dynode layer. In the condition illustrated in FIG. 5A, a first such bi-layer 201*a* has been formed on the anode structure. The existing bi-layer includes a polyimide layer 203*a* which is about 6 $\mu$m thick in order to standoff ~100 V in vacuum. The Ag-5% Mg dynode 204*a* layer is 2500 angstroms thick. The dynode layer is highly conductive in order to carry appreciable current for high gain. The layer includes via liners 207*a* extending into depressions 205*a* in the polyimide layer in registration with the anode elements 232 of anode structure 228. The via liners have electron-emissive material on their interior surfaces. The via liners are filled with a sacrificial material 209*a*, so that the top surface of bi-layer 201*a* is substantially flat.

Figure 5B:
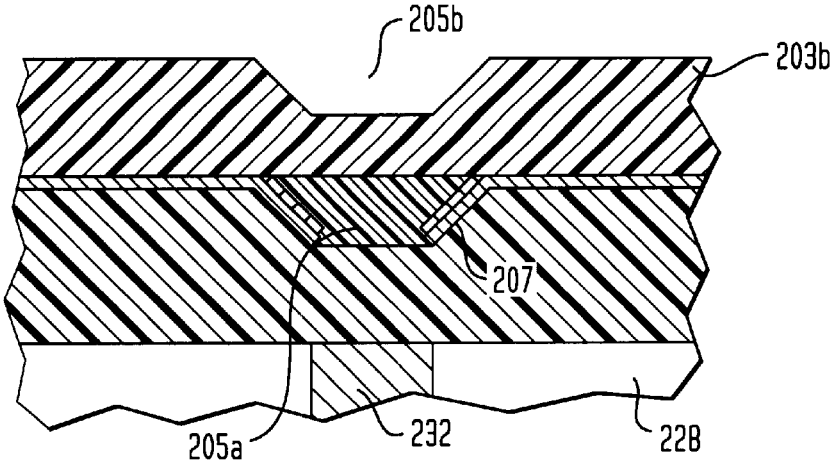
Figure 5C:
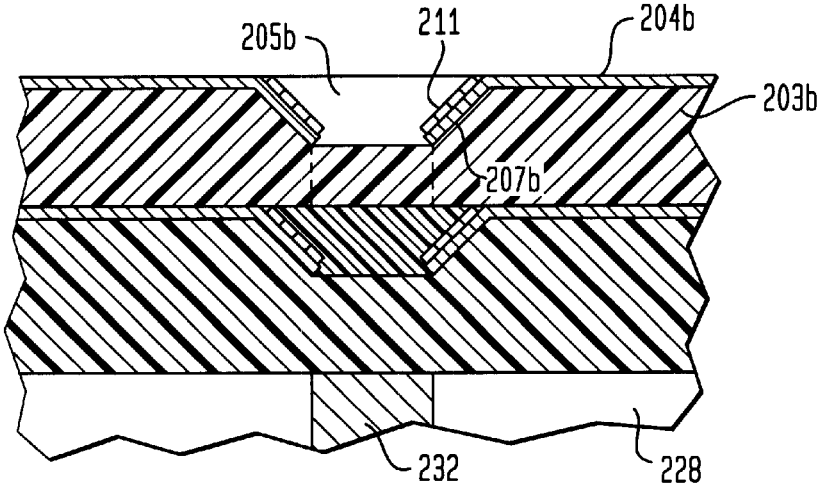

The next bi-layer is formed by depositing a polyimide layer 203*b* over the surface of the existing bi-layer. The top surface of layer 203*b* is then etched to form depressions 205*b* (FIG. 5B) in registry with the existing depressions 205*a* in the next lower bi-layer. The Ag-5% Mg dynode materials are deposited onto the polyimide to form a new dynode layer 204*b*. A deposited, the conductive dynode material covers not only the top of the polyimide space layer, but also the side walls and bottom walls of depressions 205*b*. The dynode material is etched using photolithographic processes and plasma etching to remove the conductive material from the bottom surfaces of depressions 205*b*, leaving an open-bottomed conductive liner 207*b*. An electron-emissive material 211 is then provided on the via liner either by oxidizing the metal of the dynode layer at the surfaces of the via liners or by deposition using a process such as oblique sputtering, in which the material is directed oblique to the top surface of layer 203*b*, and does not deposit on the bottom surfaces of the depressions 205*b*. Depressions 205*b* are backfilled with a sacrificial material such as photoresist, leaving a flat top surface. These steps are then repeated to build up the stack to include as many bi-layers as desired.

Figure 5D:
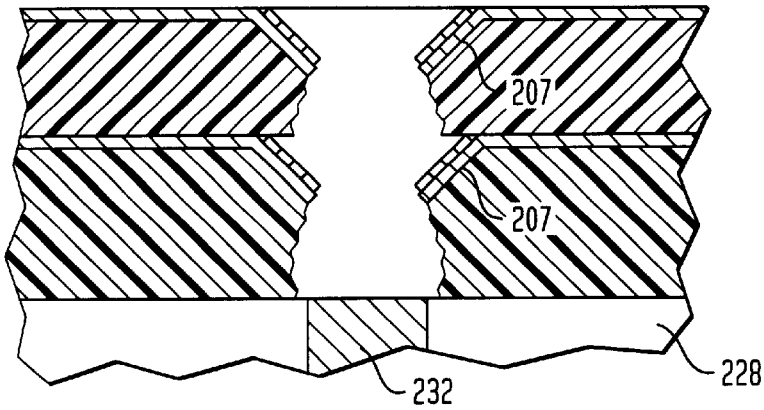
Figure 6A:
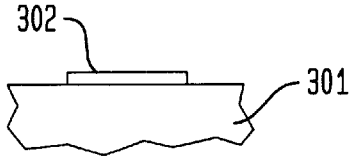
FIGS. 6A through 6D are fragmentary, diagrammatic sectional views depicting a process in accordance with yet another embodiment of the invention.
Figure 6B:
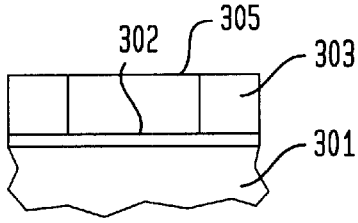
Figure 6C:
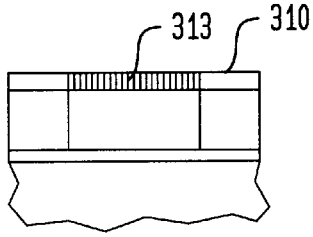
Figure 6D:
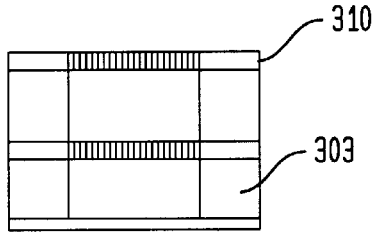

After the bi-layer is added to the structure, the microchannels must be opened through the interior of the via liners and through the underlying regions of the polyimide spacer layers. This requires removing the sacrificial plugs from the via liners in the dynode layers and any underlying polyimide. The structure is exposed to an etchant from the top surface, so that the microchannels are etched through the polyimide layers and sacrificial plugs, leaving open microchannels. In this process, the metal dynode layers act as etching masks. This process is continued until the channels are opened down to the anode structure 228 at the bottom of the stack as depicted in FIG. 5D. In a variant of this process, the etching step used to remove the polyimide may be performed after deposition of each metallic dynode layer, leaving an open hole through the associated polyimide spacer layer. The hole in the spacer layer may be filled with the same sacrificial material used to fill the via liners of the dynode material. After the entire stack is formed, the sacrificial material is removed. In this variant, the sacrificial material may be a polymer or other material resistant to the etchant used to form the spacer layer.

A process according to a further embodiment begins by providing an array of high aspect ratio posts. For example, the posts may be formed using a thermoset epoxy injected into a silicon template which has an array of deeply etched channels at the spacing and of the size of the desired microchannels. Typically, the channels in the Si matrix have an aspect ratio (channel depth to channel mean diameter from 1:1 up to 200:1) The channels in the template may be formed by an anisotropic electrochemical etching. The posts are the inverse structure of the microchannels to be formed. The epoxy posts are thermally released from the Si mold. The insulating spacer layers and the dynode layers are then deposited on the array of posts in alternating sequence until the desired number of layers are formed. An electron-emissive material other than the structural material of the dynode layer can be provided on the interior of the holes in the dynode layer by depositing the emissive material onto the posts before deposition of each dynode layer. Conductive electrode layers can be formed either as part of each deposited dynode layer or by depositing the conductive material before or after each dynode layer. The polymer posts are then removed leaving channel openings in the resulting structure.

A process in accordance with a further embodiment uses begins with a silicon wafer 301. The wafer is prepared by growing a thermal oxide on the wafer and depositing a metal film over in a pattern to provide metal anode elements 302. The anode elements can be formed by a standard lift-off technique typically used by the electronics industry. In this technique, a resist is patterned photographically to form holes in the resist where the metal is desired. The metal is deposited over the resist, and the resist is removed. The metal is removed along with the resist in all areas except the areas originally covered by the holes in the resist.

In the next step, a photodevelopable polyimide is deposited over the whole structure, by spin-coating onto the wafer directly. No additional adhesion layer is required. After the polyimide has been applied to the wafer it is soft baked at 55° C. for 120 min. to remove most of the solvent it contains. This will result in a factor of two shrinkage of the layer to a thickness of about ten microns required to stand-off the voltage required by the dynode structure. The baked structure is then exposed to patternwise illumination, as by illumination through a conventional photolithographic mass, so as to cross-link the polymer in areas 303 which will not be removed, and which will constitute a spacer layer. This leaves uncrosslinked material in areas 305, which will later form holes in the spacer layer. Development of the polyimide will be carried out at the completion of the dynode fabrication process. The unexposed, uncured regions of polyimide are left in place to provide structural support for the dynodes during processing. These regions act as self planarized sacrificial plugs in the spacer layer during the process.

After photographic exposure, a dynode layer 310 such as a two micron thick aluminum film is deposited onto the top surface of the polyimide spacer layer, as by sputtering, electron beam evaporation, CVD or other suitable deposition process. Photoresist (not shown) is applied and photographically patterned, leaving spots 313 overlying the sacrificial polyimide plugs 305 exposed, but covering the remainder of the aluminum layer. The exposed aluminum is then anodized, as by exposure to a 0.5 weight percent oxalic acid solution at 100 V. This converts the aluminum in the exposed spots 313 to an alumina mesh with nano-scale passages extending through the dynode layer. At 100 V the nano-scale passages etched into the alumina will be spaced ~0.25 microns apart.

The oxalic acid anodization process nominally creates channels that are 120 Angstroms in diameter. The nano-scale passages can be widened, typically to about 2000 Angstroms in diameter using a dilute (5 wt percent) phosphoric acid etch to etch the alumina from the side walls and bottoms of the channels. Widening the nano-scale passages increases the open area of the resulting alumina mesh. Typically, the open area of the anodized alumina foil within each spot 313 may be made as large as 65% of the surface area of the spot. This is accomplished by carrying out the passage widening etch for 30 min at 37° C. By adding some nitric acid to the channel widening solution, residual aluminum on the back side of the mesh is removed, leaving the nano-scale passages open at their ends facing the polyimide.

After the alumina mesh has been fabricated, a thin (500 A) layer of silver-2% magnesium metal will be evaporated over the structure at oblique incidence. The silver magnesium and the oxides of these metals have high secondary electron yield and can be readily deposited. Oblique deposition is required to partially coat the walls of the alumina mesh and to prevent coating the bottom of the channels. The foregoing steps are then repeated to build up additional layers of polyimide and additional aluminum dynode layers, with further alumina mesh. The spots and uncured polyimide regions are deposited in registry, one above the other.

The polyimide is then developed, removing the uncured polyimide 305 from each layer. The uncured polyimide may be washed out through the mesh structures. After development, a second imidization bake is performed on the entire structure to cure the polyimide and prevent outgasing when the structure is evacuated. The bake will be performed at 400° C. for 60 min.

Monolithic microdynode electron multipliers in accordance with the preferred embodiments of the invention combines the best feature of a MCP (very fast rise times, high spatial resolution with low cross-talk) with the virtues of a PMT that are not available with an MCP. For example, the present microdynode electron multipliers can provide long gain lifetime ~100's of C/cm$^2$ based on the surface area of the stacked structure, i.e., the area of the top or bottom surface of the stack. The device in accordance with the present invention can have very low quiescent power when the dynodes are powered individually from an active base, whereas a resistive MCP draws power at all times; high peak currents, up to ~100 mA/cm$^2$ of dynode. Some further advantages which can be provided in preferred embodiments of the invention include inherent capability to be mated directly to a 1D or 2-D array integrated circuit readout technology; the ability to fabricate single detectors, linear arrays or areal arrays; and the ability to detect electrons, ions and photons incident normal to the surface of a circuit die.

Some additional advantages which are achievable are as follows:

(1) high gain can be achieved in a compact structure, (2) elimination of the many hand assembly steps in conventional electron multiplier fabrication, (3) manufacturing economy through parts consolidation, (4) compatibility with integrated circuit fabrication processes, (5) allowing complete system integration, (6) elimination of a separate vacuum envelope; the vacuum seal is integrated into the fabrication of the dynode stack, lowering vacuum and total device volume and lower weight (7) elimination of a separate assembly of glass-metal dynode vacuum feed-throughs; the dynode feed-throughs are integrated into the structure, (8) ruggedized construction; the structure described is inherently immune to shock and vibration at typical mechanical frequencies, (9) extremely low transit times (i.e. high speed) due to the small dynode depth and the low angle electron trajectories, resulting in low transit time jitter and fast rise times,

(10) very low pixel-pixel cross-talk, since the microdynode channels are independent,

(11) considerably higher peak current and average current/area compared with a microchannel plate (MCP) of similar spatial resolution, the dynodes re-supply charge with metallic conduction, whereas an MCP is limited by the high plate resistivity,

(12) 2-D spatial resolution higher than all presently available detectors,

(13) long gain lifetime,

(14) low power consumption,

(15) very high gain per dynode stage, and

(16) low temperature dependence of the gain,

(17) easy temperature stabilization due to low mass of device.

Some potential applications for the device include the following:

Ultra-high resolution digital cameras: A microdynode PMT with pixel sizes on the order of 1 to 5 $\mu$m square would enable image quality comparable to film for still photography. Such images would be able to be enlarged for printing without compromise of the image quality.

Ultra-compact PMT: A microdynode PMT with superior temporal properties can replace conventional PMTs in many scientific applications and open new opportunities in telecommunications where solid state devices are presently employed.

Low cost PMT: Replacement tubes for such applications as CAT scanners and medical x-ray imaging. The monolithically fabricated PMT potentially is a low cost per unit cathode area per unit gain device as compared with conventional PMTs.

High Gain PMTs: Photodetectors with high (>100) gain, fully compatible with hybrid packaging and ultra-compact can be provided. These can be scaled to the diameter of a fiber optic core. For example, a 4 stage BeO monolithic dynode stack with a typical secondary yield of 6.5 per stage would obtain a gain of 1,500 with a 500 V active base, implemented as a Cockcroft-Walton multiplier in the hybrid package. A hexagonal pack of 19 dynode channels 10 $\mu$m×10 $\mu$m each would be well-matched to a 62.5 $\mu$m fiber core. The fiber optic receiver "phototube" would be about 3 mm long×70 $\mu$m wide. A 6-stage 700 V device would produce gains ~$10^5$. Such photodetectors would also be useful for portable spectroscopy in linear arrays, in well-logging especially in measurement-while-drilling, and in fiberoptic analog sensors used in medicine, analytical chemistry and manufacturing. The devices can be used as detectors on the ends of fiber optic telecommunications lines.

Ultra-Low Power Image Intensifier: An MCP requires about 100 times the power dissipated in the resistive channel plate as anode signal power. A dynode chain, if powered by an active base (i.e. not a resistor chain, but discrete voltage supply for each dynode, such as a tapped Cockcroft-Walton multiplier) dissipates almost no power except for signal generation. Therefore the monolithic microdynode phototube offers a large power savings. This would be advantageous in critical low power applications, such as satellites (astronomy, astrophysics, mission to planet earth, arms control compliance, early warning, meteorology, etc.); in ultra-miniature-compact night-vision equipment, in night vision gear and in an electron image amplifier in field emission displays.

Figure 7:
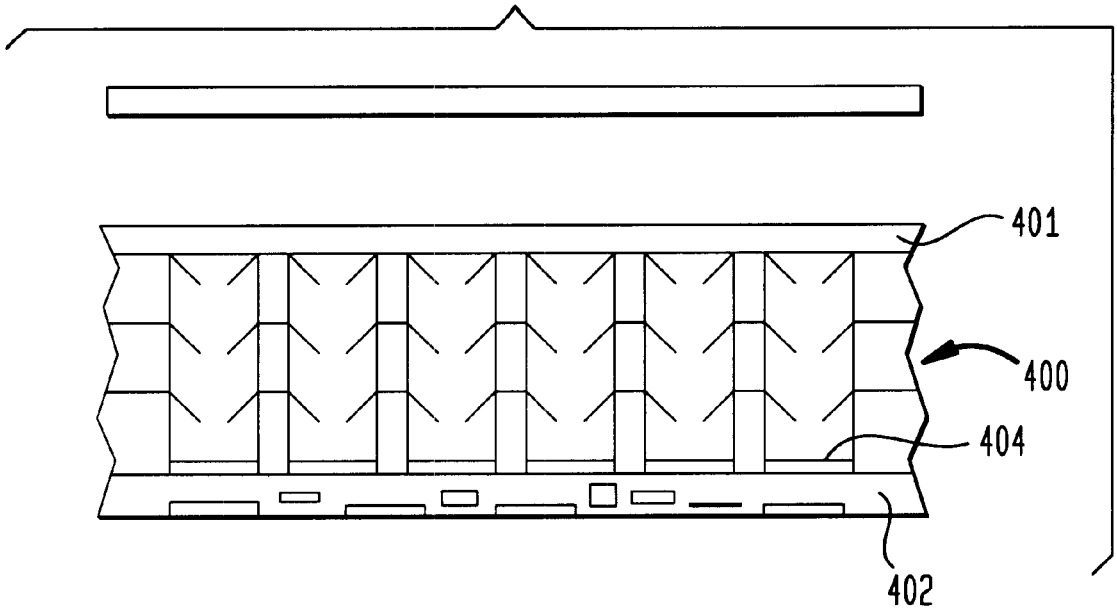
FIG. 7 is a diagrammatic sectional view depicting an assembly including a dynode assembly in conjunction with other components in accordance with a further embodiment of the invention.
Figure 8:
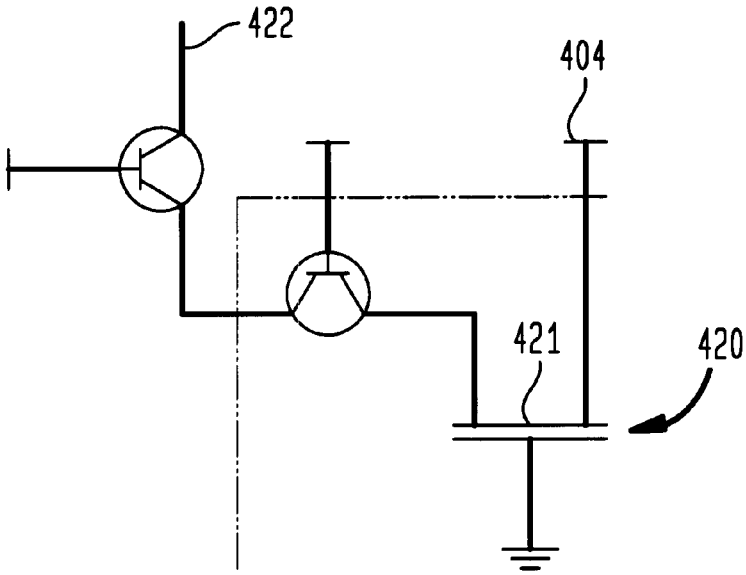
FIG. 8 is a fragmentary circuit diagram depicting a part of an electronic circuit in the assembly of FIG. 8.

Ultra-High-Gain Image Intensifier: A 14 or 15 stage monolithic micro dynode phototube could easily obtain gains exceeding $10^8$–$10^9$ for small numbers of photoelectrons Ultra-Fast, Low Noise, High Dynamic Range Digital Camera: As shown in FIG. 7, a monolithic microdynode device 400 with integral photocathode structure is provided on a semiconductor device 402 incorporating a readout circuit. Preferably, the porous structure is monolithic with the semiconductor device. The porous structure of the microdynode device may be formed on the semiconductor device as discussed below. For typical applications, the microdynode device desirably provides a gain of ~10,000–1,000,000 per pixel. The semiconductor device includes a 1-dimensional or, preferably, a 2-dimensional array of anode elements 404, each associated with one microchannel of the microdynode device and hence with one pixel of the photocathode structure. The anode elements are coupled to an x-y Si readout array implemented with high speed MOS or bipolar switches, avoiding a low noise, slow serial bucket brigade as in a CCD (required by the unity gain of a CCD). For example, semiconductor device 402 may include a set of cells 406 similar to the cells of a dynamic random access memory or "DRAM". Each cell includes a storage capacitor 420 having a storage plate 421 linked through a pair of transistors to a sense output 422. The cells are arranged in an x-y array, with rows and columns. As in a DRAM, one transistor of each cell is controlled by "word line" connected to a row of cells, whereas the other transistor of each cell is connected to a "bit line" connected to a column of cells. The storage plate 421 of each cell is connected to one anode element 404. Thus, the electrons output by the associated channel of the microdynode device will appear as charge on the storage plate of the cell. The stored charges thus represent brightness of the corresponding pixels. These can be read out in the same was as data is read out from a DRAM.

Circuits for actuating the bit lines and word lines of DRAMs are well known. A readout speed approaching the limits of switches (~500 MHz, and beyond) is in principle possible. A linear dynamic range of $4\times10^3$ (12 bits) is a reasonable maximum expectation for dynode multiplication. A 1D linear array with readout speed ~500 MHz would find applications in machine vision systems for example.

Ultra-Rugged PMT and Image Intensifiers: The structure of the monolithic micro dynode phototube is more representative of a ceramic IC package than a glass PMT or Image Intensifier envelope. The structure can be viewed as an array of individual PMT dynode channels ~10 $\mu$m×10 $\mu$m. It is conceivable to have a 1 mm thick sapphire photocathode window bonded to supports fabricated into the first dynode, spaced on that same scale (sapphire is compatible with the Si structural material). Such an imaging phototube could be used in high dynamic loading environments with little protection, such as in rocket vehicles (defense and otherwise) and geophysical exploration.

Figure 9:
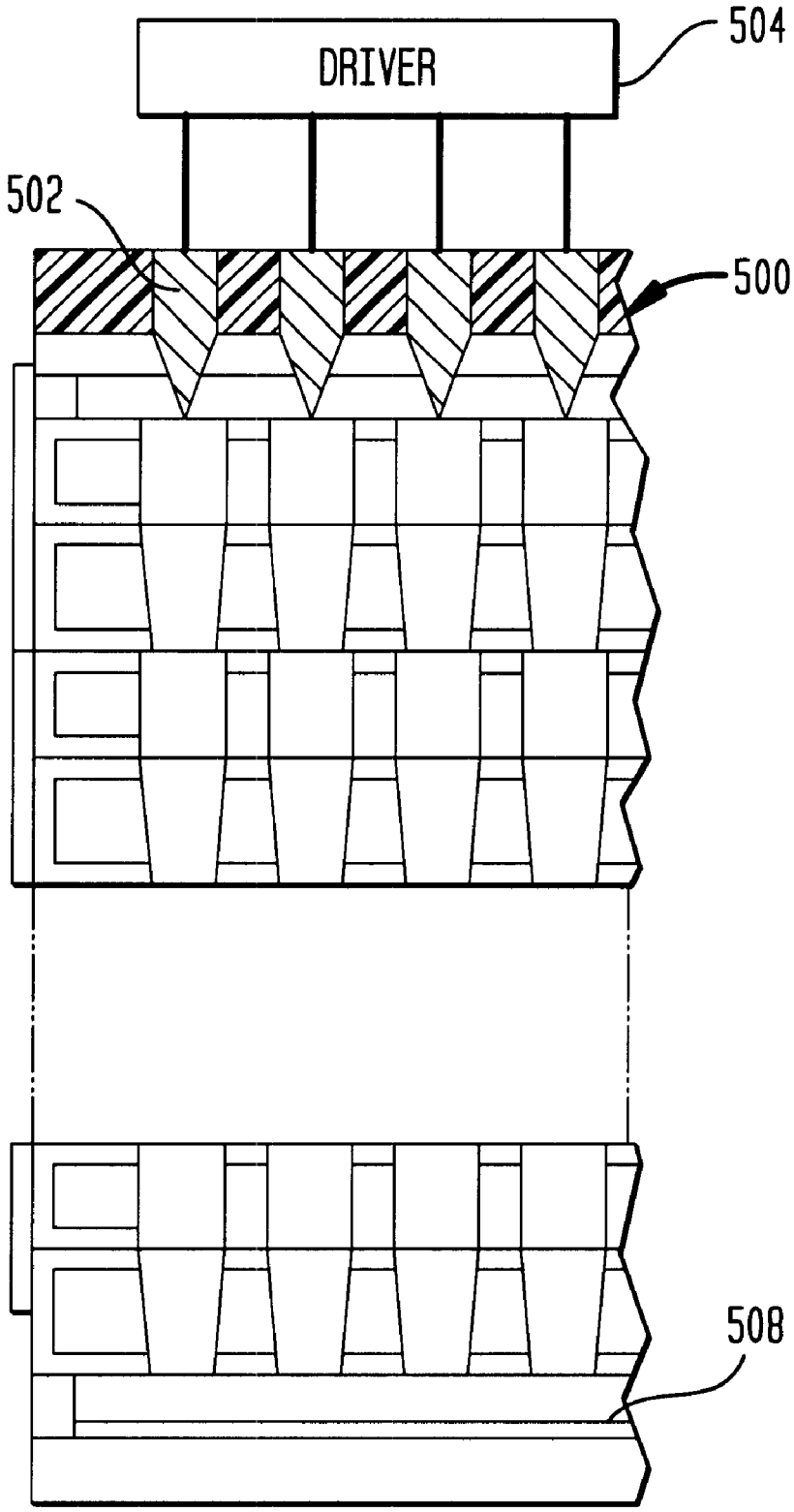
FIG. 9 is a diagrammatic sectional view depicting apparatus in accordance with yet another embodiment of the invention.

According to a further embodiment of the invention, using the microdynode structure is used in a flat-panel display. In this arrangement, the cathode structure 500 (FIG. 9) includes a plurality of individual cathode elements 502, each aligned with one microchannel of the porous structure. The cathode elements may be conventional field-emission cathodes having pointed structures or other structures which promote electron emission. A driver circuit 504, which may include a switching network and address decoder of the type used in existing field-emitter type flat panel displays is provided. The anode structure 508 has a phosphor layer and a transparent structural layer. Circuit 504 is arranged to selectively connect individual cathode elements 502 to a source of electrical voltage, so that the selected cathodes are energized. This causes individual microchannels associated with the energized electrodes to carry electron currents, thereby energizing selected spots on the phosphor layer of anode structure 508. The cathode structure, including part or all of the driver circuit and the conductors required to carry the current to the individual cathode elements may be formed as part of the same monolithic unit as the porous structure, using conventional semiconductor fabrication techniques. An anode structure using a phosphor layer can also be combined with a cathode structure incorporating a photocathode, as shown in the foregoing description. This provides a photomultiplier as, for example, for night-vision applications.

NOISE AND GAIN THEORY

The lower limit of light detection for a photomultiplier tube is determined by the electrical noise associated with dark current. Dark current primarily originates from three sources, ohmic leakage, thermionic emission of electrons from the photocathode and dynode surfaces, and regenerative effects. Ohmic leakage is due to poor insulating properties of the materials or from contaminants that short circuit the bias voltage giving rise to a current that "appears" as a signal. The primary noise source for the sensor is the thermionic noise generated by the photocathode. This noise source is exponential with temperature. Electrons generated by thermionic emission are multiplied by the gain of the tube and form noise which is random in time.

At high dynode voltages another form of regenerative dark current develops. The sources of regenerative noise are from sources of light emission taking place inside the tube, due to some forms of breakdown or due to charging of spots on the glass envelope and fluorescence due to electron bombardment. These light emission sources within the tube can illuminate the photocathode giving rise to photoelectrons. Other sources of noise can originate from field emission within the tube and from scintillations in the glass envelope caused by radioactive elements in the glass such as $^{40}$K.

The gain of a dynode chain is given by $G=(CS)^N$, where C is the collection factor for the secondary electrons from each stage, S is the secondary electron yield of the dynode and N is the number of dynode stages. If the secondary electron yield of the dynode material is ~4, and the collection factor ~1, a 10 stage device would have a gain of ~$10^6$. The output of this device does not require any unusual means of amplification. For example, incident powers of 1 mW/cm$^2$ at 500 nm at the photocathode would result in an output current at a gain of $10^6$ of ~0.4 mA. At low light levels ~10 nW/cm$^2$ the current output would be ~4 nA.

A gain of $10^6$ corresponds to $10^6$ output electrons per photoelectron input to the microdynode. A quantum efficiency of 20%, in the photocathode corresponds to ~5 incident photons per photoelectron. A device having these parameters would provide an output of 200,000 electrons for each incident photon. By comparison, a typical well in a CCD has a capacity of ~100,000–300,000 electrons, and requires 200,000 photons to provide a charge of 200,000 electrons. This illustrates the tremendous sensitivity of the gain mechanism of the electron multiplier stages.

In the embodiments discussed above, the potential sources are unmodulated sources providing a constant potential. However, the voltages provided by the potential sources can be modulated so as to provide varying bias voltages and thus vary the gain of the device. Moreover, in the devices discussed above, the conductive electrode layer associated with each dynode layer is a unitary conductive layer extending to all parts of the dynode layer. Thus, the same bias voltage is applied within all of the holes in a dynode layer, and the gain of the device is uniform over the surface of the device. However, the conductive layers can be patterned to provide individual conductors extending to single holes, or to groups of holes, so that the gain of individual microchannels or groups of microchannels can be modulated separately. For example, the dynamic range of an imaging device can be enhanced by reducing the gain of particular microchannels associated with brightly-illuminated pixels. Also, a 2-dimensional array of signals such as signals representing the brightness of pixels in a first image can be used to modulate the gains of signals in the microchannels of a 2-dimensional imaging dynode array, thus modulating a the brightness of each pixel of a second image amplified by the dynode array with the brightness of the corresponding pixel in the first image.

As these and other variations and combinations of the features discussed above can be utilized without departing from the present invention, the foregoing description of the preferred embodiments should be taken by way of illustration rather than by way of limitation of the invention as defined by the claims.

What is claimed is:

1. A microdynode device comprising:

(a) a porous structure defining an entry side, and an exit side, said structure including a plurality of dynode layers and a plurality of electrically insulating spacer layers disposed in alternating sequence between said entry side and said exit side, said structure defining a plurality of elongated microchannels extending side-by-side through said layers, each said microchannel having an entrance aperture adjacent said entry side and an exit aperture adjacent said exit side, and a lengthwise direction between said ends, each said microchannel having a mean diameter less than about 150 microns, said structure defining walls surrounding each microchannel from said entry aperture to said exit aperture and segregating each said microchannel from the other said microchannels;

(b) an electron-emissive material in said microchannels within said dynode layers; and (c) means for connecting said dynode layers to biasing voltages wherein said electron-emissive material is selected from the group consisting of amorphous and crystalline:

(d) Group IV semiconductors;

(e) semiconductors having a composition according to the formula $A_xB_{1-x}C_yD_{1-y}$ wherein A and B are each independently selected from the group consisting of B, Al, Ga, In, and Tl, wherein C and D are each independently selected from the group consisting of N, P, As, Sb and Bi and wherein x and y are in the range from 0 to 1; and (f) n and p types of the semiconductors recited in (d) and (e).

2. A microdynode device comprising:

(a) a porous structure defining an entry side, and an exit side, said structure including a plurality of dynode layers and a plurality of electrically insulating spacer layers disposed in alternating sequence between said entry side and said exit side, said structure defining a plurality of elongated microchannels extending side-by-side through said layers, each said microchannel having an entrance aperture adjacent said entry side and an exit aperture adjacent said exit side, and a lengthwise direction between said ends, each said microchannel having a mean diameter less than about 150 microns, said structure defining microchannel walls surrounding each microchannel from said entry aperture to said exit aperture and segregating each said microchannel from the other said microchannels, said dynode layers defining dynode regions of said microchannel walls;

(b) an electron-emissive material in said microchannels within said dynode layers, and (c) means for connecting said dynode layers to biasing voltages, wherein said dynode layers of said structure are formed from a nonconductive or semiconductive structural material with a conductive material overlying said structural material on said dynode regions of said microchannel walls.

3. A device as claimed in claim 1, wherein said conductive material is selected from the group consisting of Al, Ni, Cr, Au, Cu, Be, Ag, Mg and alloys thereof.

4. A device as claimed in claim 1, wherein said structural material consists essentially of silicon.

5. A microdynode device comprising:

(a) a porous structure defining an entry side, and an exit side, said structure including a plurality of dynode layers and a plurality of electrically insulating spacer layers disposed in alternating sequence between said entry side and said exit side, said structure defining a plurality of elongated microchannels extending side-by-side through said layers, each said microchannel having an entrance aperture adjacent said entry side and an exit aperture adjacent said exit side, and a lengthwise direction between said ends, each said microchannel having a mean diameter less than about 150 microns, said structure defining walls surrounding each microchannel from said entry aperture to said exit aperture and segregating each said microchannel from the other said microchannels;

(b) a cathode structure overlying said entry side of said porous structure so that regions of said cathode structure are exposed to said entrance apertures of said microchannels, said regions of said cathode structure exposed to said entrance apertures being adapted to emit electrons;

(c) an anode structure overlying said exit side of said porous structure;

(d) an electron-emissive material in said microchannels within said dynode layers; and (e) means for connecting said dynode layers to biasing voltages;

wherein said cathode structure and said anode structure are sealingly connected to said porous structure, to form a unitary sealed structure, and wherein said porous structure, said cathode structure and said anode structure cooperatively maintain a vacuum within said microchannels.

6. A device as claimed in claim 5 wherein said cathode structure includes a photocathode adapted to emit electrons in response to light impinging on the photocathode.

7. A device as claimed in claim 6 wherein said anode structure includes a plurality of separate anodes overlying said exit apertures of said microchannels.

8. A device as claimed in claim 7 wherein said plurality of separate anodes includes individual anodes aligned with individual exit apertures of said microchannels, whereby the electrons impinging on the individual anode associated with each microchannel will represent light impinging on the region of the photocathode overlying the entry aperture of that microchannel.

9. A device as claimed in claim 5 wherein said anode structure includes a phosphor layer adapted to emit light in response to electrons impinging on the phosphor, and wherein said cathode structure includes a plurality of individual cathodes and means for selectively energizing individual cathodes to cause individual cathodes to emit, whereby selected portions of said phosphor layer may be actuated to emit light by energizing selected ones of said cathodes.

10. A microdynode device comprising:

(a) a porous structure defining an entry side, and an exit side, said structure including a plurality of dynode layers and a plurality of electrically insulating spacer layers disposed in alternating sequence between said entry side and said exit side, said structure defining a plurality of elongated microchannels extending side-by-side through said layers, each said microchannel having an entrance aperture adjacent said entry side and an exit aperture adjacent said exit side, and a lengthwise direction between said ends, each said microchannel having a mean diameter less than about 150 microns, said structure defining walls surrounding each microchannel from said entry aperture to said exit aperture and segregating each said microchannel from the other said microchannels;

(b) an anode structure overlying said exit side of said porous structure, said anode structure including a phosphor layer adapted to emit light in response to electrons impinging on the phosphor;

(c) a cathode structure overlying said entry side of said porous structure so that regions of said cathode structure are exposed to said entrance apertures of said microchannels, said regions of said cathode structure exposed to said entrance apertures being adapted to emit electrons, said cathode structure including a plurality of individual cathodes and means for selectively energizing individual cathodes to cause individual cathodes to emit, whereby selected portions of said phosphor layer may be actuated to emit light by energizing selected ones of said cathodes;

(d) an electron-emissive material in said microchannels within said dynode layers; and (e) means for connecting said dynode layers to biasing voltages.

* * * * *

UNITED STATES PATENT AND TRADEMARK OFFICE

CERTIFICATE OF CORRECTION

PATENT NO. : 6,384,519 B1 
DATED : May 7, 2002
INVENTOR(S) : Charles P. Beetz, John W. Steinbeck, Robert W. Boerstler and David R. Winn It is certified that error appears in the above-identified patent and that said Letters Patent is hereby corrected as shown below:

Column 1,
Line 55, "~100" should read -- ˜100 --.

Column 2,
Line 35, "~60" should read -- ˜60 --.

Column 9,
Line 10, "32" should read -- 31 --.
Line 49, "46" should read -- 44 --.

Column 11,
Line 29, "64" should read -- 62 --.
Line 43, "50" should read -- 54 --.
Line 51, "34" should read -- 28 --.
Line 53, "62" should read -- 64 --.

Column 12,
Line 22, "32" should read -- 31 --.
Line 25, "24" should read -- 20 --.
Line 56, "32" should read -- 31 --.

Column 13,
Line 22, "~10" should read -- ˜10 --.
Line 54, delete spacing after "M. J. J."

Column 16,
Line 24, "~0.25" should read -- ˜0.25 --.
Line 64, "~100's" should read -- ˜100's --.

Column 17,
Line 3, "~100" should read -- ˜100 --.

Column 18,
Line 12, "~$10^5$" should read -- ˜$10^5$ --.
Line 44, "~10,000" should read -- ˜10,000 --.
Line 54, after "cells" delete -- 406 --.

UNITED STATES PATENT AND TRADEMARK OFFICE

CERTIFICATE OF CORRECTION

PATENT NO. : 6,384,519 B1 
DATED : May 7, 2002
INVENTOR(S) : Charles P. Beetz, John W. Steinbeck, Robert W. Boerstler and David R. Winn It is certified that error appears in the above-identified patent and that said Letters Patent is hereby corrected as shown below:

Column 19,
Line 3, "~500" should read -- ˜500 --.
Line 6, "~500" should read -- ˜500 --.
Line 12, "~10" should read -- ˜10 --.

Column 20,
Line 10, "~4" should read -- ˜4 --.
Line 11, "~$10^6$" should read -- ˜$10^6$ --.
Line 15, "~0.4" should read -- ˜0.4 --.
Line 16, "~4" should read -- ˜4 --.
Line 23, "~100,000" should read -- ˜100,000 --.

Column 21,
Line 52, "1" should read -- 2 --.
Line 55, "1" should read -- 2 --.

Signed and Sealed this

Seventeenth Day of December, 2002

JAMES E. ROGAN
*Director of the United States Patent and Trademark Office*